United States Patent [19]

Shibayama et al.

[11] Patent Number: 4,988,221

[45] Date of Patent: Jan. 29, 1991

[54] SPECIFIC DATA INPUT ORDER FOR CONTINUOUS STRIPS OF TAGS INCLUDING LINE SPACING AMOUNT

[75] Inventors: Tooru Shibayama, Kanagawa; Tadashi Watanabe, Tokyo; Mitsuharu Takahashi, Kanagawa, all of Japan

[73] Assignee: Kabushiki Kaisha Sato, Japan

[21] Appl. No.: 463,866

[22] Filed: Jan. 5, 1990

Related U.S. Application Data

[63] Continuation of Ser. No. 211,135, Jun. 22, 1988, abandoned, which is a continuation of Ser. No. 524,128, Aug. 16, 1983, abandoned.

[30] Foreign Application Priority Data

Aug. 17, 1982 [JP] Japan ..... 57-141632

[51] Int. Cl.[5] ..... B41J 5/30

[52] U.S. Cl. ..... 400/61; 400/76; 400/555; 400/583; 101/288

[58] Field of Search ..... 400/61, 62, 68, 70, 400/583, 76, 120, 545, 555, 582; 101/288

[56] References Cited

U.S. PATENT DOCUMENTS

| | | | |
|---|---|---|---|
| 4,085,837 | 4/1978 | Takano et al. | 400/583 |
| 4,086,660 | 4/1978 | McBride | 400/61 |
| 4,264,396 | 4/1981 | Stewart | 101/288 |
| 4,268,179 | 5/1981 | Long et al. | 400/120 |
| 4,311,399 | 1/1982 | Wegryn et al. | 400/902 |
| 4,312,045 | 1/1982 | Jean et al. | 400/124 |
| 4,386,860 | 6/1983 | Price et al. | 101/288 |
| 4,403,301 | 9/1983 | Fessel | 400/62 |
| 4,407,692 | 10/1983 | Torbeck | 101/288 |
| 4,422,376 | 12/1983 | Teraoka | 400/120 |
| 4,434,911 | 3/1984 | Sakura | 101/288 |
| 4,439,257 | 3/1984 | Sato et al. | 101/288 |
| 4,669,381 | 6/1987 | Nakajima | 101/288 |
| 4,712,929 | 12/1987 | Kitaoka | 101/288 |

FOREIGN PATENT DOCUMENTS

| | | | |
|---|---|---|---|
| 52848 | 6/1982 | European Pat. Off. | 400/61 |
| 2356079 | 5/1974 | Fed. Rep. of Germany | 400/582 |
| 2713128 | 9/1978 | Fed. Rep. of Germany | 400/583 |
| 23523 | 3/1978 | Japan | 400/583 |
| 42842 | 3/1980 | Japan | 400/583 |
| 46976 | 4/1980 | Japan | 101/288 |
| 55-105781 | 8/1980 | Japan . | |
| 56-9886 | 1/1981 | Japan . | |
| 56-16283 | 2/1981 | Japan . | |
| 24271 | 2/1982 | Japan | 101/288 |
| 89981 | 6/1982 | Japan | 400/61 |
| 144778 | 9/1982 | Japan | 400/882 |
| 2120821 | 12/1983 | United Kingdom | 101/288 |

OTHER PUBLICATIONS

Dobson et al., "Paper Insertion Apparatus . . ." IBM Technical Disclosure Bulletin, vol. 21, No. 10, pp. 4107–4108, 3/79.

*Primary Examiner*—David A. Wiecking

*Attorney, Agent, or Firm*—Ostrolenk, Faber, Gerb & Soffen

[57] ABSTRACT

A printing device for a continuous strip of tags prints a plurality of lines on each of the tags. The device allows free selection and easy changing of line spacing. The device for a continuous strip of tags has a feed mechanism for feeding the strip of tags, a printing mechanism for printing a plurality of lines on each tag of the continuous strip of tags and a data memory circuit for storing input printing data. The printing data input to the data memory circuit is required to consist of character data corresponding to contents of the plurality of lines, followed by line spacing data for each line, followed by data indicating the number of tags.

11 Claims, 6 Drawing Sheets

SPECIFIC DATA INPUT ORDER FOR CONTINUOUS STRIPS OF TAGS INCLUDING LINE SPACING AMOUNT

This is a Continuation of application Ser. No. 07/211,135, filed on June 22, 1988, by Tooru Shibayama et al. entitled "PRINTING DEVICE FOR CONTINUOUS STRIP OF TAGS", now abandoned which is a continuation of application Ser. No. 06/524,128, filed on Aug. 16, 1983, by Tooru Shibayama et al. entitled "PRINTING DEVICE FOR CONTINUOUS STRIP OF TAGS", now abandoned.

BACKGROUND OF THE INVENTION

1. Field of the Invention

The present invention relates to a printing device for printing a continuous strip of tags. More specifically, the present invention relates to a printing device for printing on a continuous strip including a plurality of tags fed to the printing device, which is capable of allowing free and easy selection of line spacing as needed.

2. Description of the Prior Art

Known printing devices of this type include drum impact, thermal and electrostatic printers. In the known devices, the line spacing is fixed. This represents a major drawback since the required line spacing is often different for each user.

In the prior art devices, the manufacturer of the apparatus presets the line spacing for each individual user. This has prevented standardization of printing devices. Furthermore, even an individual user may want to change the line spacing depending upon the size or design of the tags and the number of printing lines which, in turn, change in accordance with the selected type of tags used or the required printing contents.

BRIEF SUMMARY OF THE INVENTION

The present invention has been made in consideration of this and has for its object to provide a printing device for a continuous strip of tags which allows free selection of line spacing as needed.

It is another object of the present invention to provide a printing device for a continuous strip of tags which makes it easy to change the line spacing.

It is still another object of the present invention to provide a printing device for a continuous strip of tags which is simple in construction, is easy to operate, and can withstand use over a long period of time.

According to the present invention, line spacing data which may be freely set is stored in a memory along with character data representing the information to be printed. The line spacing is determined in accordance with the desired line spacing data.

There is provided according to the present invention a printing device for a continuous strip of tags, having a feed mechanism for feeding the continuous strip of tags, a printing mechanism for printing one or more lines on each tag of the continuous strip of tags, and a data memory circuit for storing input printing data, characterized in that the printing data stored in the data memory circuit includes both character data indicative of the desired information to be printed and line spacing data indicative of the desired spacing between successive lines of the information to be printed.

BRIEF DESCRIPTION OF THE DRAWINGS

The foregoing and other objects of the present invention will become more apparent from the following description of preferred embodiments taken in connection with the accompanying drawings, in which.

DETAILED DESCRIPTION OF THE PREFERRED EMBODIMENTS

The preferred embodiments of the present invention will now be described with reference to the accompanying drawings.

Figure 1:
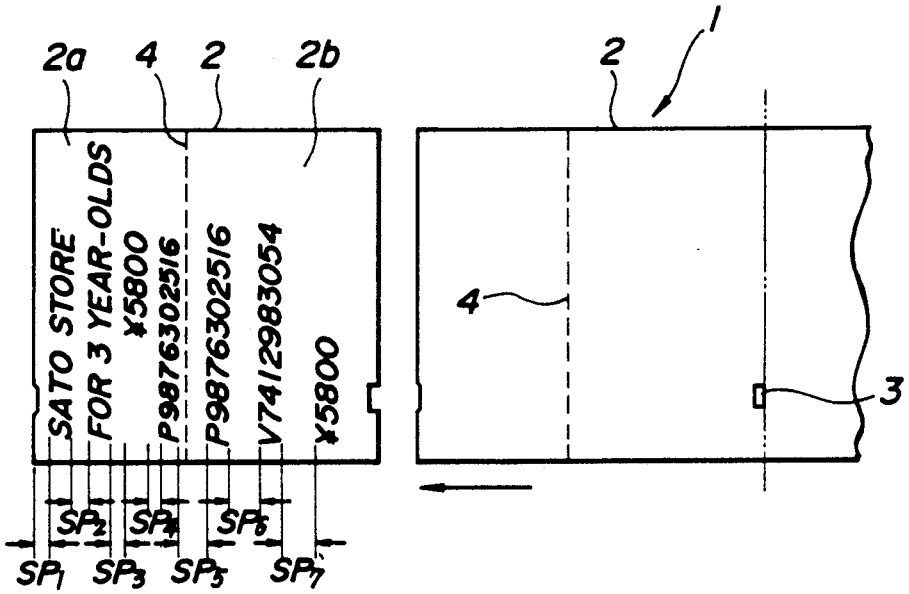
FIG. 1 is a view showing an example of a continuous strip of tags.
Figure 6:
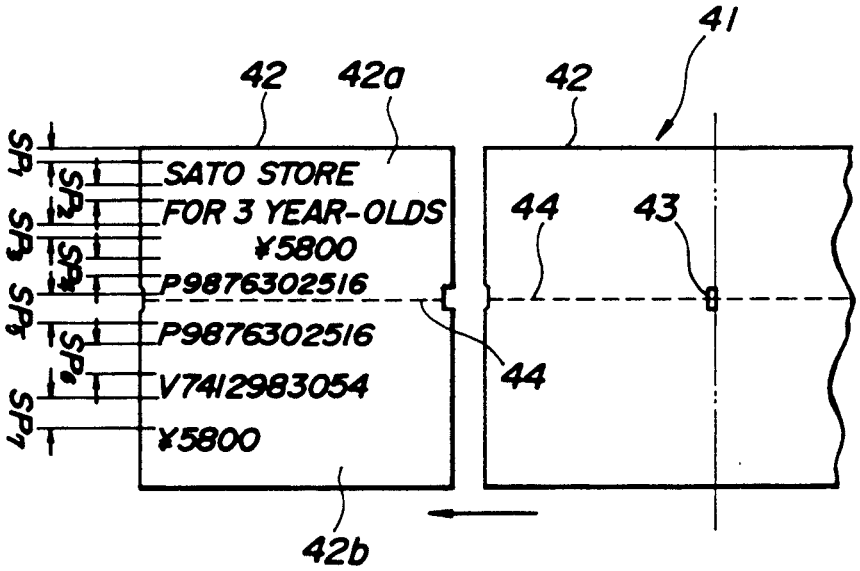
FIG. 6 is a view showing a continuous strip of another type of tag.

Examples of tags which are provided in a continuous strip are price tags, tickets, labels, etc. In the embodiments disclosed, the tags as shown in FIG. 1 or 6 are used. It should be recognized, however, that other tags can be used with the present invention.

FIG. 1 shows a longitudinally continuous strip 1 of a plurality of tags 2. An aperture 3 is formed between each pair of adjacent tags 2. After printing, the strip 1 is cut at the positions of the apertures 3 so as to provide individual tags 2. A perforation 4 is formed widthwise along the center of each tag 2 so as to separate it into a user's portion 2*a* and a data processing portion 2*b*.

In the example shown in FIG. 1, the information to be printed includes seven lines of data. The first line of data specifies the name of the store, the second line of data specifies the age group which the merchandise is directed towards, the third line of data specifies the price of the goods, the fourth and fifth lines provide code information which may be representative of the department in which the goods are sold, the sixth line contains further code information which may identify the goods in question, and the seventh line also contains price information. Each line of data (hereinafter "data line") is spaced from the preceding data line (or from the beginning of the tag 2 in the case of the first data line) by a respective line spacing $SP_1$, $SP_2$, etc.

Figure 9:
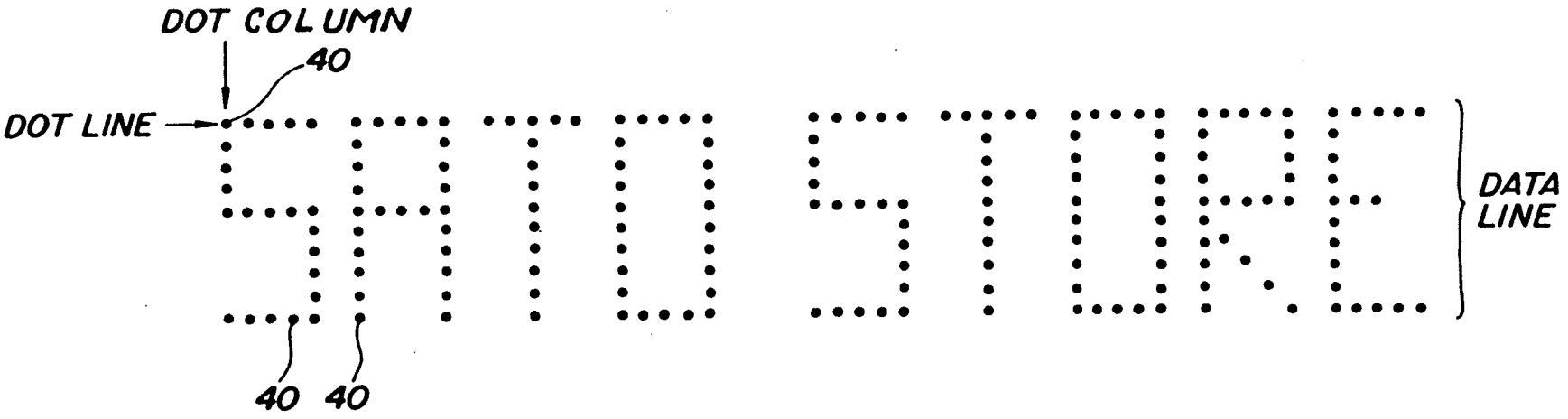
FIG. 9 is an enlarged view of the first data line of the tag of FIG. 1.

In the presently preferred embodiment, each of the characters printed are printed in the form of a dot matrix. FIG. 9 illustrates the manner in which the first line of data (SATO STORE) can be printed in dot matrix form. By way of example, the individual characters are illustrated in the form of a 5 (column) by 10 (row) matrix. In this manner, each character can be stored digitally in the form of a $5\times10$ matrix, each dot position being stored digitally as a binary "1" (representing the location of a dot at a given dot position 40) or a binary "0" (representing the absence of a dot at a given dot position 40). In the example illustrated in FIG. 9, the letter "S" is stored digitally:

11111
10000
10000
10000
11111
00001
00001
00001
00001
11111

Figure 2:
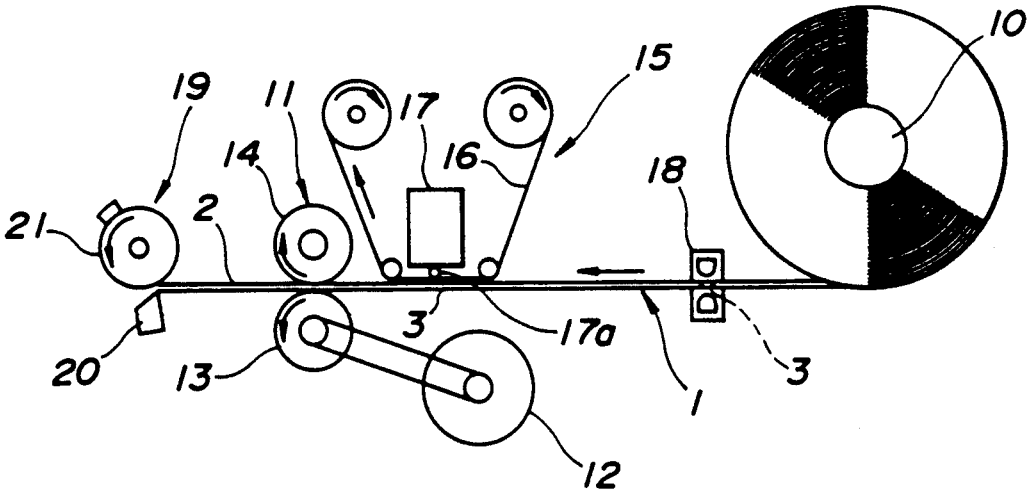
FIG. 2 is a schematic view showing the overall structure of a printing device according to the present invention.

As shown in FIG. 2, the strip 1 is wound around a tag supply drum 10. The strip 1 supplied from the tag supply drum 10 is fed by a pulse motor 12 and a feed mechanism 11 having a pair of feed rollers 13 and 14 driven by the pulse motor 12. A printing mechanism 15 prints the desired information on each tag 2 of the strip 1. In the preferred embodiment, the printing mechanism 15 is a thermal printer including a thermal transfer printing ribbon 16 (which is intermittently fed in the direction shown) and a thermal printing head 17 having a number of heaters 17*a* arranged along the direction of width of the strip 1 (into the plane of FIG. 2). The thermal printing head 17 prints the character information in the form of the dot matrix such as that described above. The strip 1 is intermittently stepped past the print head 17. Each time it is stopped, selected heaters 17*a* are enabled and brought into contact with the ribbon 16 so as to print selected dots of either a given dot line or of a given dot column. When printing a tag of the type illustrated in FIG. 1, appropriate heaters 17*a* print dots corresponding to a single dot line of each of the characters in a given data line (e.g., the top dot line of each of the characters in SATO STORE). When printing onto the tag of FIG. 6, appropriate heaters 17*a* print the dots of a single dot column of all the characters in the same column of tag 2 (e.g., S, F, P, P, V, Y in FIG. 6). By enabling selected heaters 17*a* for either each dot line (FIG. 1) or for each dot column (FIG. 6), and by stepping the tags through all of the dot lines of all of the data lines or all of the dot columns of all of the data columns, it is possible to print all of the character data on the tag. The manner in which this is carried out is described in greater detail below.

A photosensor 18 detects each aperture 3 of the strip 1. The feed mechanism 11 and the printing mechanism 15 operate in accordance with detection signals generated by the photosensor 18. The strip 1 is cut at the position of each aperture 3 between adjacent printed tags 2 by a cutting mechanism 19 having a stationary blade 20 and a rotary blade 21.

Figure 3:
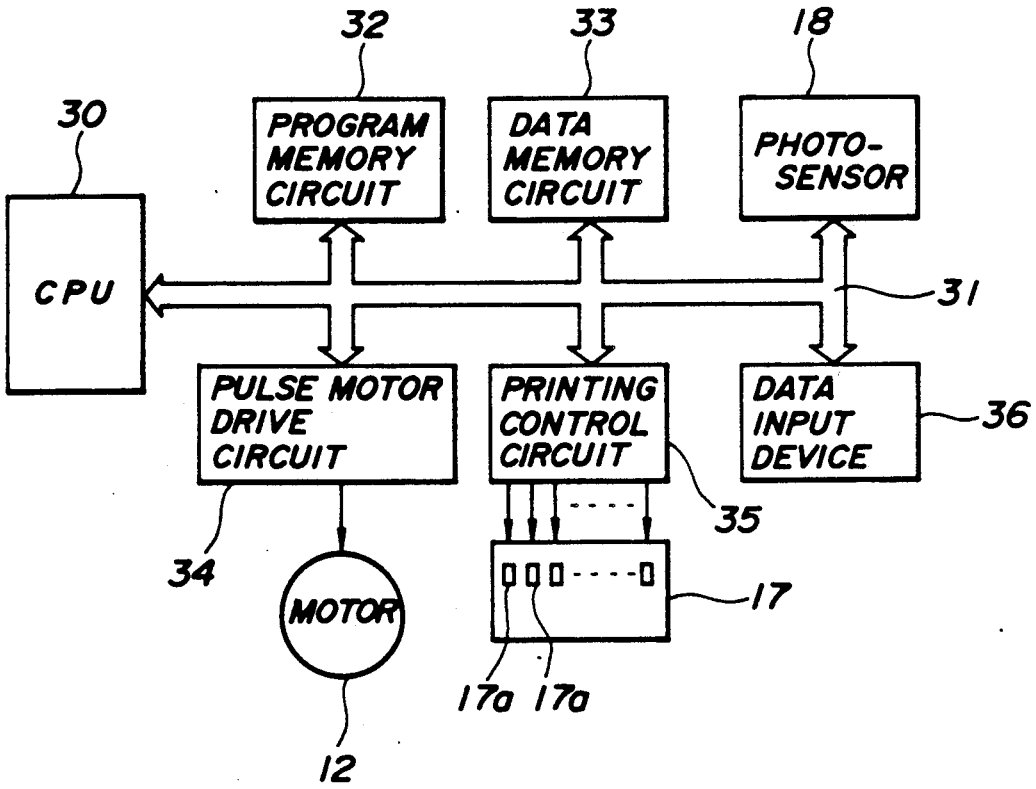
FIG. 3 is a block diagram of a control circuit of the device shown in FIG. 2.

A drive circuit for driving the printing device as described above will now be described with reference to FIG. 3.

A CPU 30 for controlling the overall circuit is connected to a program memory circuit 32 and a data memory circuit 33 through a bus line 31. The bus line 31 is also connected to the photosensor 18, a pulse motor drive circuit 34, a printing control circuit 35 and a data input device 36. The data input device 36 is for input of the printing data and may comprise, for example, a keyboard, an external computer or the like.

Figure 4:
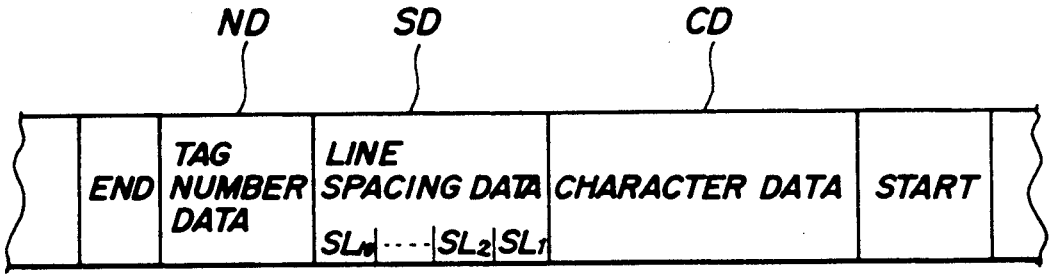
FIG. 4 shows the preferred format of the printing data.

The printing data is input through the data input device 36 and is stored in the data memory circuit 33. The printing data preferably has a format as shown in FIG. 4. In accordance with this format, the printing data consists of a start signal followed by character data CD, line spacing data SD, and tag number data ND. An end signal following the tag number data ND indicates the end of the printing data.

The character data CD represents the information to be printed on each tag 2 (e.g., the seven data lines of FIG. 1). The tag number data ND represents the number of tags on which the same information is to be printed. The line spacing data SD represents the number of steps of the pulse motor 12 which corresponds to the distance of each respective line spacing $SP_1$, $SP_2$, etc. In the presently preferred embodiment, the line spacing data SD includes ten line spacing values SL(1), SL(2) . . . SL(10) which correspond to ten respective line spacings $SP_1$, $SP_2$ . . . $SP_{10}$. Thus, if each step of the pulse motor 12 corresponds to 10 mils and the first line spacing $SP_1$ is 80 mils, the line spacing value SL(1) will correspond to eight.

The values SL(1), SL(2) . . . SL(10) may be freely preset and may be set to "0" for an unnecessary line. In the embodiment being considered, seven lines are printed as shown in FIG. 1. Therefore, the values SL(1) to SL(7) are suitably set to correspond to the line spacings $SP_1$ to $SP_7$. The line spacing values SL(8) to SL(10) are set to "0".

Figure 5:
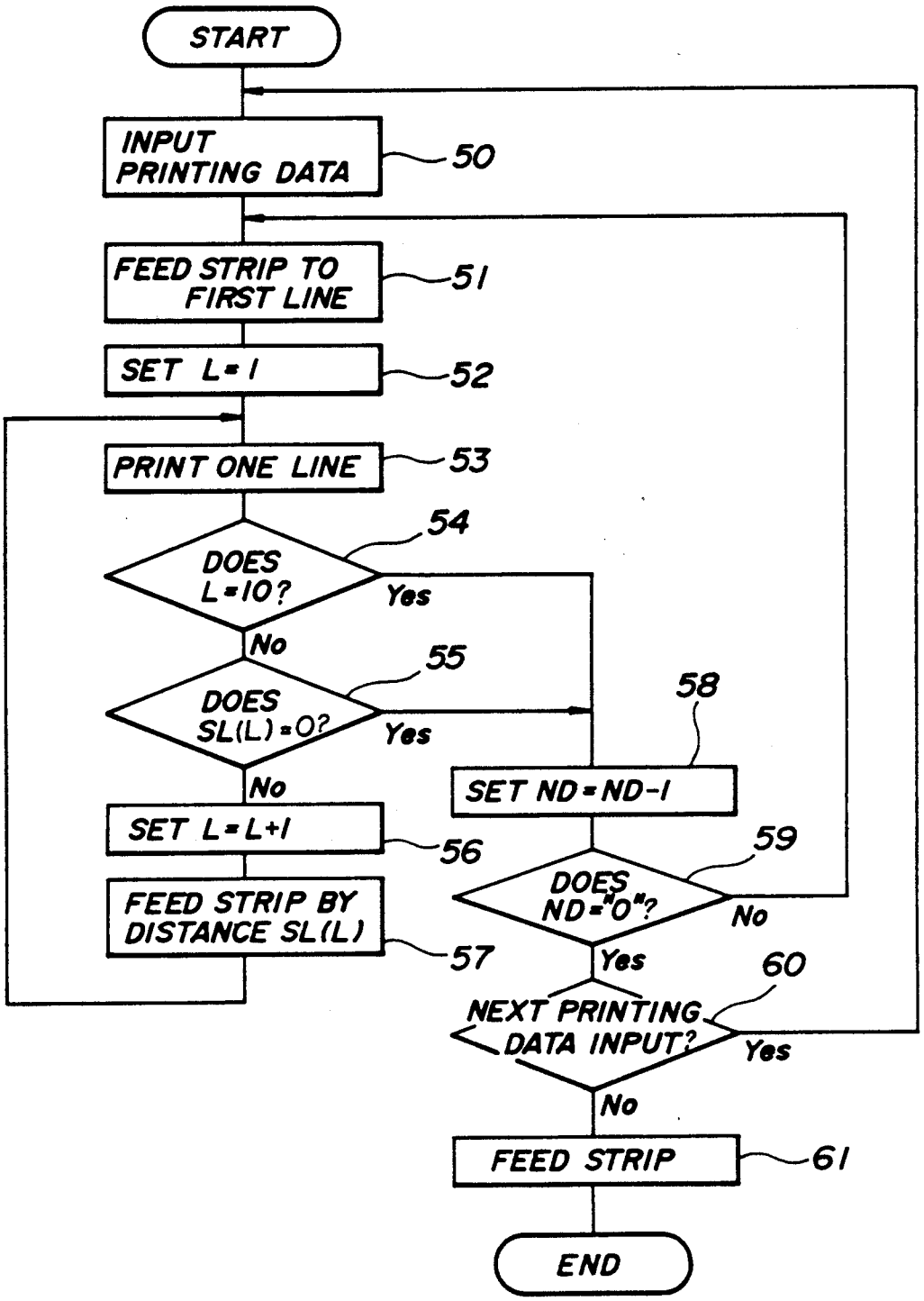
FIG. 5 is a flow chart of a computer program stored in the program memory circuit of FIG. 3 and used to print data on the tag of FIG. 1.

The printing operation for each tag 2 of the strip 1 in accordance with the printing data stored in the data memory circuit 33 will now be described with reference to the flow chart shown in FIG. 5.

The program first proceeds to instruction block 50, wherein the printing data, shown by way of example in FIG. 4, is input through the data input device 36 and is stored at a predetermined memory area of the data memory circuit 33.

When the inputting of the printing data is completed, the program proceeds to instruction block 51 and the strip 1 is fed such that the position of the first dot line of the first data line to be printed is aligned with the heaters 17*a* of the thermal printing head 17. This is accomplished as follows.

The spacing of the apertures 3 is such that when a first aperture 3 is at the position corresponding to the heaters 17*a*, a second (e.g., the next) aperture 3 is at the photosensor 18. In response to a detection signal from the photosensor 18 (generated whenever it detects an aperture 3), the pulse motor 12 rotates for the number of steps corresponding to line spacing value SL(1). As a result, the strip 1 is fed for a distance corresponding to the line spacing $SP_1$ with reference to the position of the aperture 3. This causes the location of the first dot line of the first data line to be printed to align with the lined heaters 17*a* of the thermal printer 17.

At this point, the program proceeds to instruction block 52 wherein the line variable L is set equal to one, indicating that the first data line is being printed. Proceeding to instruction block 53, the program causes the first data line to be printed. When printing the tag of FIG. 1, each data line is printed by printing successive dot rows of each character in the data line. Referring to FIG. 9, the first dot line of each of the characters "S, A, T, O, S, T, O, R, E" will be printed followed by the second dot line of each character, etc. The manner in which this is carried out can best be understood with reference to FIG. 7 which is a block diagram of the printing control circuit 35.

Figure 7:
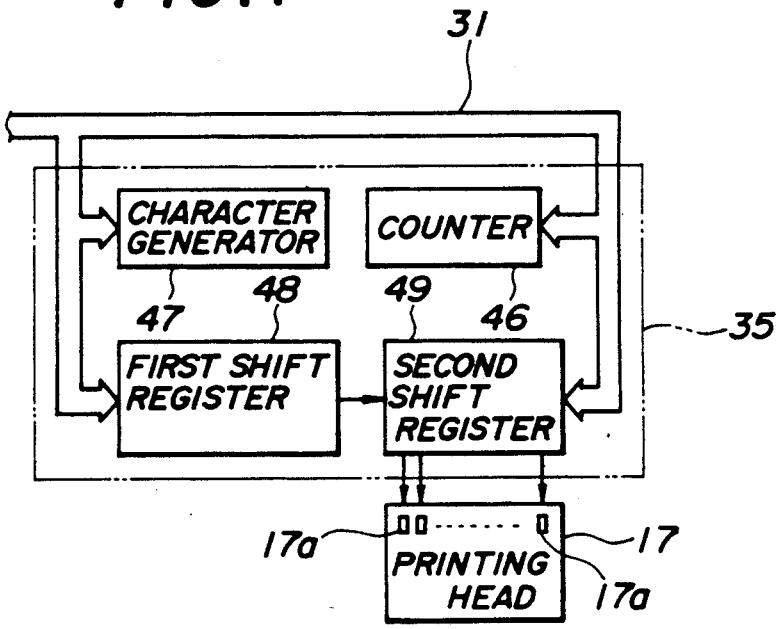
FIG. 7 is a view showing a main portion of the control circuit shown in FIG. 3.

As shown in FIG. 7, the printing control circuit 35 includes a counter 46, a character generator 47 and first and second shift registers 48, 49. Character generator 47 stores all of the characters in dot matrix form. One commercially available device which can be used for this purpose is a bit character generator sold by NEC Corp. under the product designation μPD 481 D-001. This product is essentially a read only memory which stores 128 characters in dot matrix form (an eight column by 16 row matrix). Individual rows of a given character may be read out of the character generator (in parallel) by applying a first address identifying a particular character to be generated and a second address identifying the specific dot row of that character to the character generator 47. In this manner, the CPU 30 can cause the character generator 47 to place any dot line of any one of the 128 characters on the bus 31 when desired. Presuming that the first dot line of the first line of data of the tag of FIG. 1 is to be printed, the CPU 30 will cause the character generator 47 to place the first dot line of the character "S" onto the data bus 31. The parallel bits of this dot row are first shifted into the first shift register 48. To this end, the CPU 30 places a count in counter 46 corresponding to the number of bits in a single dot row (eight bits in the example being considered). CPU 30 then generates clock pulses which are applied both to the counter 46 and to shift registers 48 and 49. These clock pulses decrement the count in counter 46 and cause the bits in shift register 48 to be transferred into shift register 49. This process continues until the count in counter 46 is 0 at which time all of the bits of the dot row of the character in question are shifted into shift register 49.

Once these bits have been shifted into shift register 49, a number of binary 0's corresponding to the spacing between adjacent characters (this will generally be a preset number) are then shifted into shift register 49. This is done by setting the count in counter 46 equal to a number corresponding to the spacing between adjacent characters and then applying clock signals to both the counter 46 and the shift registers 48 and 49. Each clock signal reduces the count in counter 46 by 1 and causes another bit to be transferred from shift register 48 to shift register 49. Since shift register 48 will be blank at this time, binary 0's will be shifted into shift register 49. Once the count in counter 46 is 0, the number of binary 0's corresponding to the spacing between adjacent characters will have been placed in counter 49.

At this point, the CPU 30 causes the character generator 47 to place the bit information corresponding to the first dot line of the "A" onto bus 31 and the entire process is repeated until the first dot line of each of the characters "SATO STORE" is read into shift register 49 so as to enable appropriate heaters 17*a* of printing head 17. At this point, the printing head 17 will be lowered into contact with the printing ribbon 16 to cause the first dot line of the first data line to be printed onto the tag 2.

After the first dot line has been printed, the print head 17 will be returned to its raised position and the CPU 13 will cause the pulse motor 12 to step a predetermined number of steps corresponding to the spacing between adjacent dot lines. The CPU will then cause the printing control circuit 35 to enable those heaters 17*a* corresponding to the dots of the second dot line to be printed and the process will be repeated until all of the dot lines of the first data line have been printed.

When printing of the first data line is completed, the program proceeds to decision block 54 and determines if the line variable L is equal to 10 (the maximum number of lines which can be printed on a tag in the embodiment illustrated). If not, the program proceeds to decision block 55 wherein it determines if the variable SL(L) is equal to zero. In the illustrated example, the first seven times through the loop encompassing blocks 53–57, the line spacing value will be other than zero, and the program will pass to instruction block 56. In the eighth pass through the loop, the line spacing value SL(8) will be equal to zero and the program will proceed to instruction block 58. As a result, whenever the printing mechanism has printed either the maximum number of lines (10 in the example being considered) or all the data lines of the character data CD (7 in the example being considered), it will exit the loop encompassing blocks 53–57 and will proceed to block 58. As will be described in detail below, this will cause the program to repeat the loop encompassing blocks 53–57 for each successive character data CD until all of the character data stored in data memory circuit 33 to be printed on each tag has been printed.

Returning to block 56, the variable L is increased by one. The first time through the loop, L will be increased to two. Proceeding to instruction block 57, CPU 30 causes the motor 12 to be incremented by a number of steps determined by the line spacing data SL(2) which has the effect of bringing the heaters 17*a* of the printing head 17 into alignment with the first dot line of the second data line. The appropriate heaters 17*a* are then enabled and the printing head 17 is brought into contact with the ribbon 16 so as to print the second dot line. This process is repeated until all seven data lines have been printed at which time the program proceeds to instruction block 58.

In instruction block 58, the tag number variable ND is decremented by one. The tag number variable ND corresponds to the tag number data for the character data being printed. Proceeding to decision block 59, CPU 30 determines if the variable ND is equal to zero. If not, there are additional tags to be printed and the program returns to instruction block 51. The program will continue proceeding through this loop until all of the tags corresponding to the data CD have been printed at which time the tag number index ND will be equal to zero. At this point, the program proceeds to decision block 60 wherein it determines if there is any further printing data (another set of data ND, SD, CD) to be printed. If so, it returns to instruction block 50 and the entire process is repeated. When all the data stored in data memory circuit 33 has been printed, the program proceeds to instruction block 61 which causes the strip 1 of tags 2 to be fed a predetermined distance so that all of the printed tags have been cut by the cutter 19.

In the embodiment described above, the construction and operation of the device have been described with reference to a case wherein information is printed on a strip 1 of tags 2 which are longitudinally continuous and the data lines extend traverse to the travelling direction of web 1 as shown in FIG. 1. However, the construction and operation of the device are as follows when information is printed on a strip 41 of tags 42 wherein tags 42 are transversely continuous and the data lines extend parallel to the travelling direction of web 1 as shown in FIG. 6.

As shown in FIG. 6, the strip 41 consists of a number of tags 42 continuous in the transverse direction. An aperture 43 is formed between each pair of adjacent tags 42. The strip 41 is cut after the printing operation has been completed at the portion corresponding to each aperture 43 to provide individual tags 42. A perforation 44 is formed widthwise at the center of each tag 42. The perforation 44 divides each tag 42 into a user's portion 42*a* and a data processing portion 42*b*.

When printing is to be performed on the strip 41 of tags 42 which are transversely continuous, the structure of the device and the format of the printing data remain the same as those of the embodiment described with reference to FIGS. 2 and 4.

The primary difference between the structure of the device used to print the tags of FIG. 1 and that used to print the tags of FIG. 6 lies in the character generator 47 (FIG. 7). In this embodiment, the character generator 47 again stores each character in dot matrix form. The character generator is so constructed, however, that the dot information can be read out dot column by dot column rather than dot line by dot line. One commercially available character generator which can be used for this purpose is manufactured by NEC Corp. under the product designation μPD482D. This product will store 128 characters in dot matrix form, each matrix being a 10 (column)×9 (row) matrix. The character generator 47 has two sets of addresses, the first set identifying the desired one of the 128 characters, the second set identifying the particular column of that character to be read out.

Presuming that the first dot column of the first data column of the tag 42 of FIG. 6 is to be printed, the CPU 30 will first cause the character generator 47 to place the dot information corresponding to the first dot column of the letter "S" on bus 31 and will then serially shift this parallel bit data into shift register 48. Thereafter, the information will be serially shifted into second shift register 49. Since those heaters 17*a* corresponding to the line spacing $SP_2$ must not be enabled, CPU 30 must insert a number of binary 0's corresponding to the line spacing $SP_2$. To this end, CPU 30 places a count in counter 46 corresponding to the line spacing $SP_2$. This will be determined by the line spacing value SL(2). Thereafter, CPU 30 begins generating clock signals which both decrease the count in counter 46 and cause the bit information in shift register 48 (all binary 0's) to shift into shift register 49. This process continues until the count in counter 46 is 0 with the result that a number of binary 0's corresponding to the line spacing value SL(2) will be placed in second shift register 49. Thereafter, CPU 30 causes character generator 47 to place the dot information corresponding to the first dot column of the character "3" to be shifted into shift registers 48 and 49 and the process is repeated until all of the character information for a single dot column of a single character column has been placed in second shift register 49.

Figure 8:
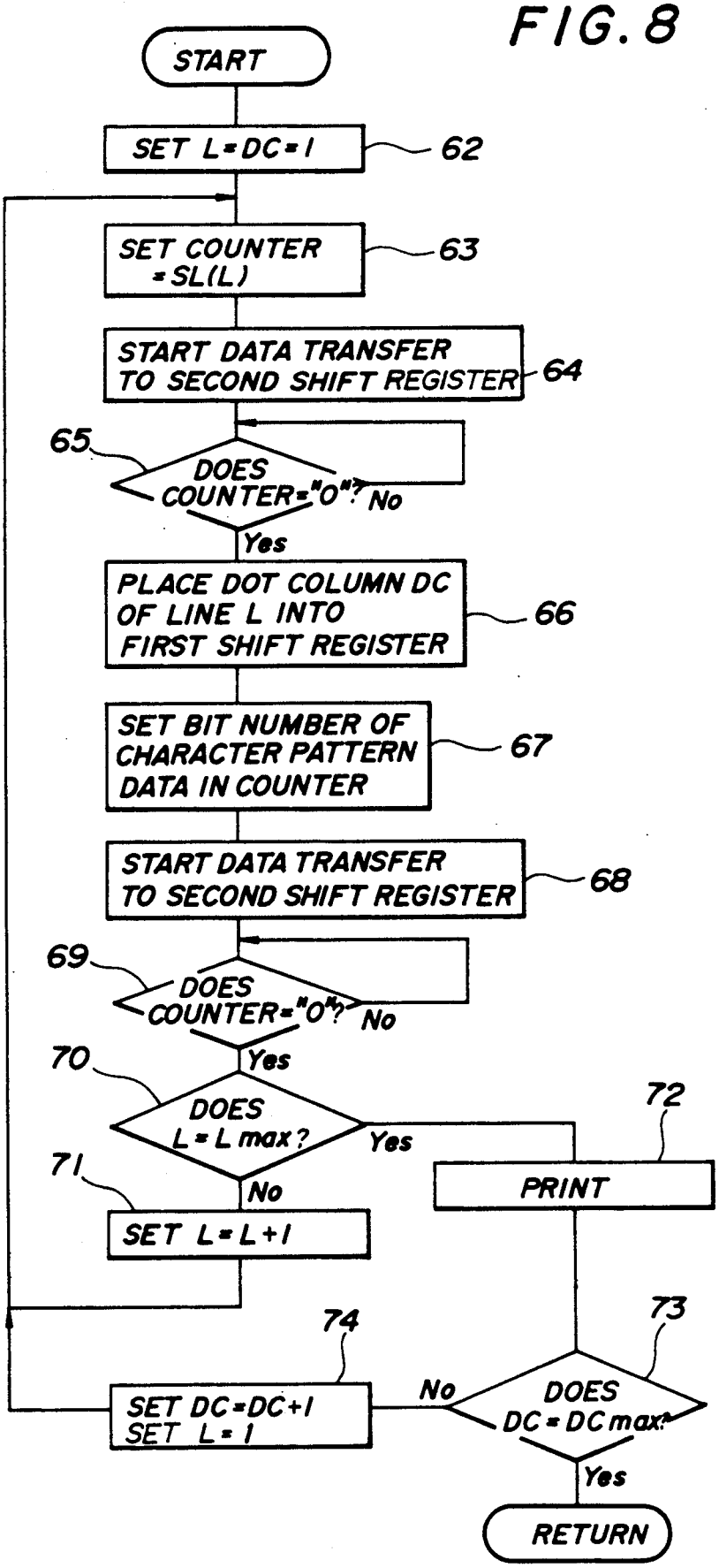
FIG. 8 is a flow chart of a computer program stored in the program memory circuit of FIG. 3 and used to print data on the tag of FIG. 6.

The particular flow chart for printing data on the tag of FIG. 6 will now be described with reference to the flow chart of FIG. 8. In this flow chart, it is presumed that all of the printing data has already been entered into the data memory circuit 33. Additionally, this flow chart only describes the manner in which the first data column is printed. The process is repeated for each successive data column of the tag 42.

Proceeding first to instruction block 62, the CPU 30 sets both the line index L and the dot column index DC equal to 1. The CPU 30 then sets the count in counter 46 equal to the line spacing value SL(1). See block 63.

Once the value SL(1) is set in the counter 46, the contents in the first shift register 48 are transferred to the second shift register 49 in response to a clock signal from the CPU 30. See block 64. During this transfer operation, binary 0's are transferred from shift register 48 to shift register 49 since the first shift register 48 is in the cleared state. Each time a single bit is transferred from register 48 to register 49, the counter 46 is decremented by one in response to a clock signal from the CPU 30. A determination is then made in decision block 65 as to whether the count of the counter 46 is "0". When it is, the program proceeds to instruction block 66. When the count of the counter 46 is "0", a number of binary zeroes equal to the line spacing value SL(1) will have been transferred to the second shift register 49. The contents in the second shift register 49 thus constitute the line spacing $SP_1$.

Proceeding to instruction block 66, CPU 30 causes the character generator 47 to place the DCth dot column of the first character of the Lth data line into shift register 48. As indicated by instruction block 67, CPU 30 also sets the count in counter 46 equal to the number of bits in the dot column of the single character. The contents of the first shift register 48 are then transferred to the second shift register 49 in response to a clock signal from the CPU which also decrements the count in counter 46. This process is repeated until the count in counter 46 is equal to 0 (instrument block 69) at which point all of the bits of data corresponding to the dot column of the character in question have been placed into shift register 49.

Proceeding to decision block 70, CPU 30 then determines if the line value L is equal to the maximum line value Lmax. If it is, this indicates that the dot information corresponding to a single dot column of all the data lines have been placed into shift register 49 and that the print head 17 can be brought into contact with the ribbon 16 (instruction block 72). If L is less than Lmax, then the program proceeds to instruction block 71 wherein the line index L is increased by one and the program returns to instruction block 63. This process is continued until the bit information corresponding to a single dot column of all of the data lines has been placed into shift register 49.

Once the dot information in shift register 49 has been printed (block 72), CPU 30 proceeds to decision block 73 and determines if the dot column index DC is equal to the maximum dot column index DCmax. The value of DCmax corresponds to the total number of dot columns in the standard matrix (10 columns in the example being considered). If DC is less than DCmax, CPU 30 proceeds to instruction block 74 where it increases the dot column index DC by 1 and sets the line index L equal to 1, and the program returns to instruction block 63 so that the next dot column can be printed. This process continues until all of the dot columns have been printed.

In this manner, when printing is to be performed for a strip 41 of tags 42 which are transversely continuous, the intervals between each character pattern data are set in accordance with the line spacing data SD so as to determine the line spacings $SP_1$, $SP_2$, etc.

In the embodiments described above, a printing device of thermal type is described. However, the present invention may be similarly applied to printing devices of various other types such as dot printers, electrostatic printers, or wire dot matrix printers. In the first embodiment wherein the strip 1 of tags 2 as shown in FIG. 1 is to be printed, the line spacings $SP_1$, $SP_2$, etc. are determined by controlling the distance the strip 1 of tags 2 is fed in accordance with the line spacing data SD. Accordingly, the present invention may be similarly applied to a drum impact printing device of the line printer type.

Furthermore, in the embodiments described above, the line spacings $SP_1$, $SP_2$, etc. are set. However, it is possible to supply character spacing data so as to freely set the spacing between characters in the row direction. In particular, when printing is to be performed on a strip 1 of tags 2 as shown in FIG. 1, the intervals between the character pattern data are set in accordance with the character spacing data. However, when printing is to be performed on a strip 41 of tags 42 as shown in FIG. 6, the strip 41 of tags 42 is fed for a distance corresponding to the character spacing data when each column is printed.

In the examples set forth above, each character was stored in a 10×9 or 8×16 matrix. While this is sufficient for many applications, a 20×20 matrix for small characters and a 20×40 matrix for large characters is preferred if additional resolution is desired, for example, if the tag is to be read by an optical scanner.

In summary, according to the present invention, the character data representing the information to be printed as well as line spacing data for printing are stored. The line spacing is determined in accordance with the line spacing data. Since a user can freely set the line spacing, the user can readily respond to tags of different sizes or designs or can also change the number of printing lines or the like as needed. Furthermore, since it is not necessary to set the line spacing for each user, standardization of printing devices is facilitated.

The present invention may be embodied in other specific forms without departing from the spirit or essential attributes thereof and, accordingly, reference should be made to the appended claims, rather than to the foregoing specification as indicating the scope of the invention.

What is claimed is:

1. A printing device for printing a continuous strip of tags comprising a set of tags, said device comprising:

(a) a feed mechanism and a printing mechanism for feeding and printing the continuous strip of tags;

(b) data memory means;

(c) input means for receiving input printing data in a predetermined format; determining therefrom, as a function of said format, printing data specifying the printing of said set of tags; and storing said printing data in said data memory means; wherein said input means requires said format of said input printing data, for said set of tags to be printed, to consist, in this order, of:

(1) a start signal;

(2) character data CD specifying characters for at least two lines to be printed on each tag in said set of tags;

(3) at least two line spacing data values SD corresponding to said character data CD, said line spacing data values SD specifying the respective locations at which said lines are to be printed on each tag in said set of tags;

(4) a tag number data value ND specifying the number of tags in said set of tags to be printed; and (5) an end signal;

(d) a controller responsive to said data memory means which retrieves from said data memory means said input printing data for said set of tags to be printed and then prints said set of tags;

wherein said controller retrieves said start signal; said character data CD, said line spacing data values SD, said tag number data values ND; and said end signal from said data memory means, and controls said feed mechanism and said printing mechanism to print said set of tags so that the respective location of each said data line on each of said tags is determined by said respective line spacing data value SD; said set of tags consists of a number of tags determined by the respective tag number data value ND for said set of tags; and all of said tags are printed based on the input printing data.

2. The printing device of claim 1, wherein:

said feed mechanism feeds said continuous strip of tags in a first direction;

said printing mechanism prints said plurality of data lines with the characters therein oriented in a second direction, orthogonal to said first direction; and said controller is further operable for causing said feed mechanism to feed the continuous strip of tags each time said printing mechanism is to print one said data line, said feed mechanism feeding said continuous strip for a distance determined by said respective value of said line spacing data indicative of the location at which said respective data line is to be printed on said tag.

3. The printing device of claim 2, wherein said printing mechanism includes a line of dot forming members extending along said second direction and wherein said controller controls the operation of said feed mechanism and said printing mechanism in such a manner that said printing mechanism prints each of said characters of said data lines in dot matrix form and oriented in said second direction.

4. The printing device of claim 1, wherein:

said feed mechanism feeds said continuous strip of tags in a first direction; and said printing mechanism prints said plurality of data lines with the characters therein oriented in a direction parallel to said first direction.

5. The printing device of claim 4, wherein said printing mechanism includes a line of dot forming members extending along a second direction, orthogonal to said first direction, and said controller controls the operation of both said feed mechanism and said printing mechanism, in such a manner that said printing mechanism prints each of said characters of said data lines in dot matrix form, and further disables selected dot forming members, to ensure that the spacing between each pair of adjacent said data lines is in accordance with said respective value of said line spacing data.

6. The printing device of claim 1, wherein a first one of said at least two line spacing data values is representative of the spacing of a first one of said at least two data lines from an edge of said tag.

7. The printing device of claim 6, wherein a second one of said at least two line spacing data values is representative of the spacing between said at least two data lines.

8. The printing device of claim 1, wherein said input printing data includes character data identifying the respective characters of at least three data lines, and at least two line spacing data values, each being representative of the spacing between a respective pair of adjacent said data lines.

9. The printing device of claim 8, wherein said input printing data further includes a line spacing data value which is representative of the spacing of a first one of said data lines from an edge of said tag.

10. The printing device of claim 1, wherein said data memory means comprises a memory circuit having a plurality of memory locations, and said character data, line spacing data values, and tag number data values are stored at a predetermined respective memory locations of said memory circuit.

11. A printing device for printing a continuous strip of tags comprising a set of tags, said device comprising:

(a) a feed mechanism and a printing mechanism for feeding and printing the continuous strip of tags;

(b) data memory means;

(c) input means responsive to input printing data in a predetermined format; and operable for determining therefrom, as a function of said format, printing data specifying the printing of said set of tags; and storing said printing data in said data memory means; wherein said predetermined format of said input printing data, to which said input means is responsive, consists, in this order, of:

(1) a start signal;

(2) character data CD specifying characters for at least two lines to be printed on each tag in said set of tags;

(3) at least two line spacing data values SD corresponding to said character data CD, said line spacing data values SD specifying the respective locations at which said lines are to be printed on each tag in said set of tags;

(4) a tag number data value ND specifying the number of tags in said set of tags to be printed; and (5) an end signal;

(d) a controller responsive to said data memory means which retrieves from said data memory means said input printing data for said set of tags to be printed and then prints said set of tags;

wherein said controller retrieves said start signal; said character data CD, said line spacing data values SD, said tag number data values ND; and said end signal from said data memory means, and controls said feed mechanism and said printing mechanism to print said set of tags so that the respective location of each said data line on each of said tags is determined by said respective line spacing data value SD; said set of tags consists of a number of tags determined by the respective tag number data value ND for said set of tags; and all of said tags are printed based on the input printing data.

* * * * *